United States Patent [19]

Lux

[11] 3,966,176

[45] June 29, 1976

[54] METHOD AND APPARATUS FOR PRODUCING FILLED RESINS

[76] Inventor: Ivan E. Lux, P.O. Box 26, Minden, Nebr. 68959

[22] Filed: Aug. 25, 1975

[21] Appl. No.: 607,481

[52] U.S. Cl. ..... 259/108

[51] Int. Cl.[2] ..... B01F 7/16

[58] Field of Search ..... 259/108, 107, 106, 7, 259/8

[56] References Cited

UNITED STATES PATENTS

| | | | |
|---|---|---|---|
| 3,139,220 | 6/1964 | Darcy | 259/108 |
| 3,374,989 | 3/1968 | Todtenhaudt | 259/107 |
| 3,411,557 | 11/1968 | Weibull | 259/108 |
| 3,606,260 | 9/1971 | Rubin | 259/107 |
| 3,709,664 | 1/1973 | Krekelec | 259/107 |

*Primary Examiner*—Robert I. Smith
*Attorney, Agent, or Firm*—Robert A. Ostmann

[57] ABSTRACT

The disclosure concerns an improved method and apparatus for employing filled resins in chopper type fiberglass systems. The new technique is characterized by a special mixer for the resin and filler which produces a product which does not settle as fast as prior filled resins, and which has a viscosity low enough to permit use of the conventional chopper equipment employed with unfilled resins. The resin-filler mixture may be pumped directly from the mixing apparatus to the chopper gun and is free of any tendency to set in, and thus clog, the mixer.

10 Claims, 3 Drawing Figures

METHOD AND APPARATUS FOR PRODUCING FILLED RESINS

BACKGROUND AND SUMMARY OF THE INVENTION

Today, fiberglass products usually are produced using a chopper type system in which a polyester or similar epoxy resin, the appropriate catalyst and glass fiber stock are fed to a chopper gun from which these components are projected onto a mold. In cases where product weight is not critical, as, for example, bath tubs and shower stalls, the industry recognizes the desirability of incorporating in the resin a filler, such as hydrated alumina, antimony trioxide, glass beads, talc minerals or various carbonates and silicates. These fillers impart fire retardant properties to the product and also reduce considerably the amount of the relatively expensive resin which is needed. However, in the past, incorporation of fillers has presented certain difficulties, several of which are attributable directly to the fact that the filled resin has a relatively high viscosity. For example, whereas a typical unfilled polyester resin may have a viscosity of about 100 centipoises, the filled version of this resin, containing 50% by weight of hydrated alumina, may exhibit a viscosity on the order of 1,600 centipoises. This great difference makes necessary some modifications of the chopper system, namely, the removal of some filter screens from the gun, and the substitution of a larger resin hose and jet. Furthermore, the increase in viscosity necessitates a reduction of the glass content of the product from the normal 30% by weight to a level of about 20%. This, of course, decreases the tensile strength of the product. Another problem encountered with filled resins is the formation and build-up of solid, rubber-like deposits in the mixing apparatus, which necessitates periodic shutdown of the equipment for cleaning purposes. Finally, prior systems using filled resin do not allow this component to be pumped directly from the mixer to the chopper gun and are characterized by such rapid settling of the filler that around-the-clock operation of the mixer is a necessity.

The object of this invention is to provide an improved technique for using filled resins in chopper type fiberglass systems. The invention recognizes the fact that the rather vigorous agitating action of prior resin-filler mixers results in excessive evaporation of the volatile styrene constituent of the resin, and thus causes the marked increase in viscosity noted above. Accordingly, the new technique employs a special mixer which is capable of affording thorough and rapid mixing of the resin and filler in a gentle fashion. The new mixing apparatus comprises a vertical tank having a cylindrical side wall and a flat bottom, and which contains a coaxial rotor equipped with at least two axially spaced sets of equiangularly spaced, radial blades. One set of blades is positioned adjacent the bottom of the tank, and the other is located at an intermediate elevation. Each rotor blade is inclined over its entire length at an angle on the order of 45° with respect to the horizontal and in a direction which causes it to lift the mixture in the tank. The tank is equipped with a set of imperforate, radial baffles which are attached to the cylindrical wall and are spaced equiangularly about its axis. These baffles extend vertically from a region adjacent the bottom of the tank to an elevation slightly below the top of the tank, and they extend inward to a region closely adjacent the tips of the rotor blades. A prime mover carried by the tank drives the rotor at a speed which produces a relatively low tangential velocity on the order of 7 to 9 feet per second at the blade tips. Preferably, the mixing apparatus is equipped with a vertical discharge pipe which extends into the tank from above and is located at the downstream side of one of the baffles in the corner defined by it and the cylindrical tank wall.

Actual use of the new technique has revealed the following advantages:

1. Thorough mixing of the resin and filler is accomplished rapidly, e.g., in about 20 minutes.
2. The mixture, even in the case where 50% by weight of filler is employed, has a viscosity which is about one-half that of prior filled resins, and which permits use of the conventional chopper equipment employed with unfilled resins.
3. In the case of the 50—50 resin-filler mixture, a glass content of about 27% by weight in the product may be used.
4. There is no appreciable build-up of rubber-like deposits in the mixing tank.
5. The settling time of the mixture is considerably longer than in the past, being on the order of 2 – 7 hours depending upon the brand of resin employed. Moreover, the mixture could be stored in an idle tank for a period as long as 10 days and then brought to a useable state by merely operating the rotor for the usual 20-minute mixing cycle.
6. The equipment is relatively inexpensive and is sufficiently compact that a separate mixer may be installed at each spray booth. Furthermore, the filled resin could be pumped directly from the tank to the chopper gun, so an auxiliary holding vessel was not needed.

BRIEF DESCRIPTION OF THE DRAWINGS

The preferred embodiment of the invention is described herein with reference to the accompanying drawings, in which.

DESCRIPTION OF PREFERRED EMBODIMENT

Figure 1:
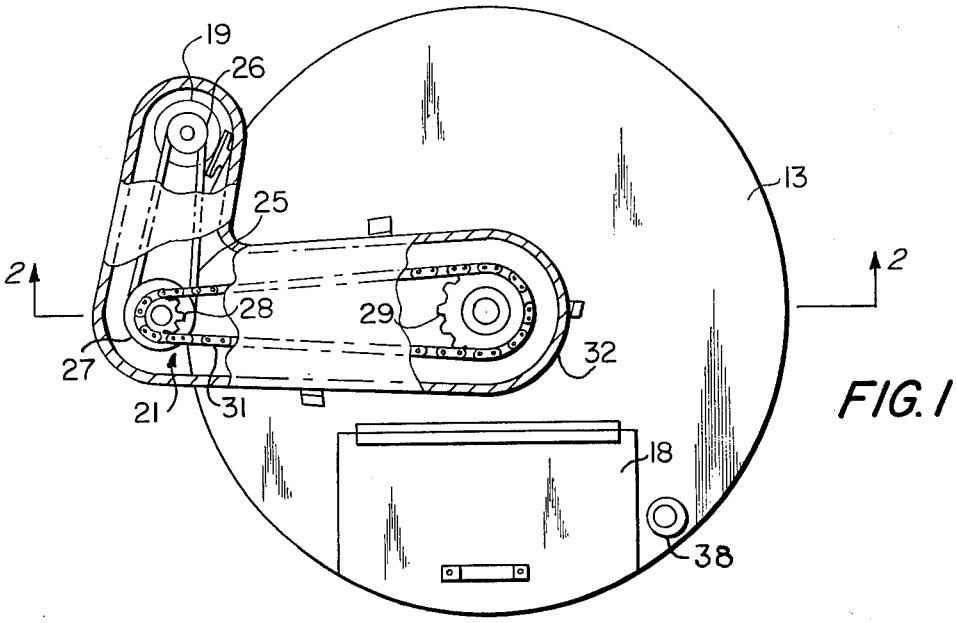
FIG. 1 is a top plan view of the preferred mixer.
Figure 2:
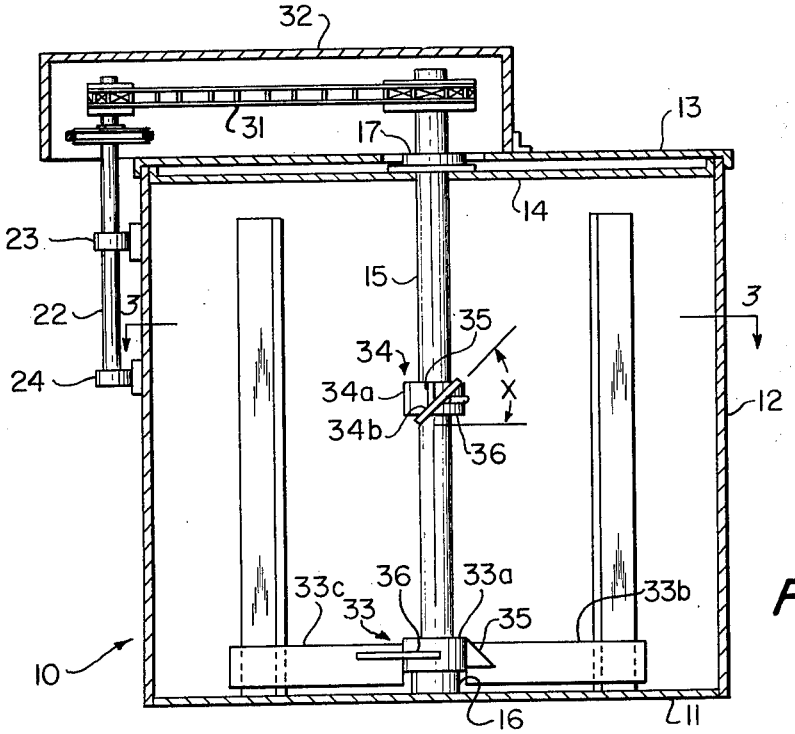
FIG. 2 is a sectional view taken on line 2—2 of FIG. 1.

As shown in the drawings, the new mixing apparatus comprises a vertical tank 10 having a flat horizontal bottom wall 11, a cylindrical side wall 12, a cover 13 and a transverse, channel-shaped support member 14. Member 14 is attached to diametrically opposed portions of wall 12 and is positioned just beneath cover 13. The tank contains a rotor shaft 15 which is supported coaxially with wall 12 by bearings 16 and 17 attached, respectively, to wall 11 and member 14. Cover 13 is provided with a hinged door 18 through which the resin and filler are introduced into tank 10.

Rotor shaft 15 is driven by an air motor 19 mounted on the outside of wall 12 through a speed-reducing drive train 21. The drive train includes a counter shaft 22 which is supported in bearings 23 and 24 attached to wall 12, and which is connected with motor 19 by a drive link including belt 25 and a pair of pulleys 26 and 27. The counter shaft, in turn, is connected with rotor shaft 15 by a second drive link which comprises sprockets 28 and 29 and a roller chain 31. A guard 32, attached to cover 13, encloses the drive train 21.

Rotor shaft 15 carries two axially spaced sets 33 and 34 of rotor blades; the lower set 33 being positioned adjacent the bottom of tank 10 and comprising a hub 33*a* which is fixed to the shaft by an appropriate connector, such as a set screw (not shown), and a pair of diametrically opposed blades 33*b* and 33*c*, and the other set 34 being positioned at an intermediate elevation of the tank and comprising a similar hub 34*a* and opposed blades 34*b* and 34*c*. The sets of blades are so oriented that the four blades are arranged equiangularly about the axis of shaft 15. Each of the blades is welded at its inner end to the associated hub and is braced by a gusset 35 and a stay rod 36. The rotor blades are flat, straight rectangular plates, and each preferably is pitched at an angle X of 45° with respect to the horizontal. Although the exact angle of inclination is not critical, it is believed that angles less than about 35° afford unacceptable mixing action, and that angles greater than about 55° result in too vigorous mixing with excessive evaporation of the styrene constituent in the resin. The direction of blade inclination must be correlated with the direction of rotation of shaft 15 so that the blades act to force the material in tank 10 in the upward direction.

Figure 3:
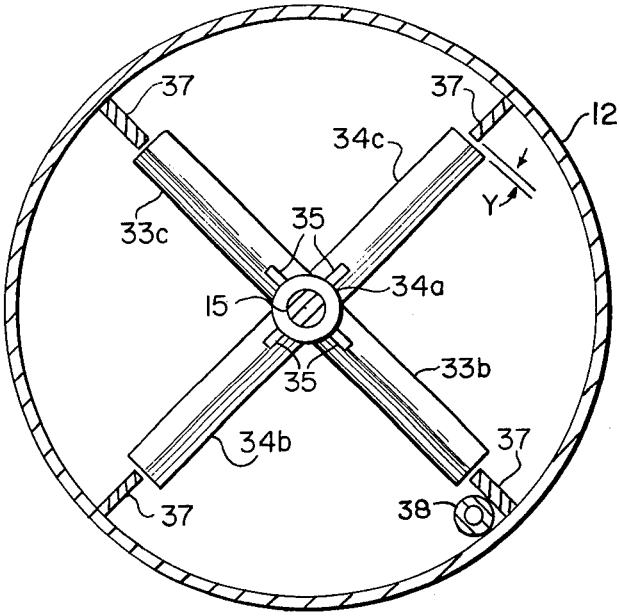
FIG. 3 is a sectional view taken on line 3—3 of FIG. 2.

Tank 10 is provided with a plurality of radial baffles 37 which are welded to the inside surface of cylindrical wall 12 and are spaced equiangularly about the axis of that wall. The number of baffles equals the number of rotor blades, and each baffle comprises a flat, straight, rectangular plate which extends vertically from the bottom wall 11 to an elevation spaced slightly below cover 13. The spacing between cover 13 and the upper ends of the baffles is selected to insure that the resin will not overflow tank 10 during mixing. The radial width of the baffles is chosen so that their inner margins are closely adjacent the tips of the rotor blades. The radial spacing Y between these parts (see FIG. 3) should be no greater than one-half inch. During mixing, the baffles serve to interrupt the circulatory motion of the resin imparted by the rotor and to create an upward surge of the material. Therefore, it is important that the baffles be imperforate and that they be mounted tight against wall 12.

The resin-filler mixture may be pumped directly from tank 10 to a chopper gun through a vertical discharge pipe 38 which is located at the downstream side of one of the baffles 37 in the corner defined by the baffle and side wall 12. The pipe exits from tank 10 through cover 13.

It is desirable to size the mixing apparatus for a day's production at one booth, which commonly requires 2,000 pounds of filled resin. An apparatus which satisfies this requirement may be dimensioned as follows:

Tank — diameter of 40 inches; height of 36 inches

Rotor Blades — tip-to-tip length of opposed blades of 31 inches; width of 4 inches Baffles — length of 32 inches; width of 4 inches; vertical spacing from cover of 4 inches The particular embodiment just mentioned has been operated successfully using a rotor speed of 50 – 65 rpm (tangential velocity at blade tips of about 7–9 feet per second). In a typical application, the apparatus was employed to mix 50% by weight of trihydrated alumina with a commercially available resin of the type formulated for use with this filler. Complete mixing of the components required about 20 minutes, and the resulting filled resin had a viscosity of about 800 centipoises. In contrast, the same kind of filled resin prepared by known techniques exhibits a viscosity on the order of 1,600 centipoises. The mixture was pumped directly from tank 10 to conventional chopper equipment (i.e., equipment of the kind normally used with unfilled resins) and was utilized without difficulty to make articles containing approximately 27% by weight of glass. Moreover, it was found that, after the initial mixing step, only periodic operation of the rotor was required to keep the resin in a useable condition. The frequency of operation depends upon the brand of resin employed, and ranged between 2 and 7 hours. In addition, it was discovered that material which has been thoroughly mixed can be held at rest in tank 10 for a period as long as ten days and then made useable for a production run by merely operating the rotor for the normal 20-minute mixing cycle. In neither this nor any other case was build-up of solids in tank 10 a problem.

I claim:

1. Apparatus for mixing resins and fillers comprising a. a vertical tank having a cylindrical side wall and a flat, horizontal bottom wall;

b. a vertical rotor shaft supported in bearings carried by the tank and coaxial with the cylindrical side wall;

c. a prime mover supported on the outside of the tank and connected in driving relation with the rotor shaft to rotate the shaft in a predetermined direction;

d. a plurality of equiangularly spaced rotor blades which are fixed to the shaft, project radially therefrom, and are arranged in at least two axially spaced sets, e. one set being located adjacent the bottom of the tank and the other being located at an intermediate elevation, f. each rotor blade being inclined at an angle on the order of 45° with respect to the horizontal so that its leading edge in said predetermined direction of rotation is at a lower elevation than its trailing edge and the blade acts to force material in the tank in the upward direction; and g. a plurality of imperforate, radial baffles attached to the inside of the side wall and spaced equiangularly about the axis thereof, h. the baffles extending vertically from a region adjacent the tank bottom to an elevation spaced slightly below the top of the tank, i. the radial width of the baffles being such that the inner margins of the baffles are closely adjacent the tips of the rotor blades.

2. Apparatus as defined in claim 1 in which the number of baffles equals the number of rotor blades.

3. Apparatus as defined in claim 1 in which both the rotor blades and the baffles are in the form of straight, flat plates.

4. Apparatus as defined in claim 1 including a mixture withdrawal pipe which extends into the tank in a region adjacent one of the baffles at the downstream side thereof in the direction of said predetermined rotation.

5. Apparatus as defined in claim 1 in which there are only two sets of blades; each set contains two blades; and there are four baffles.

6. Apparatus as defined in claim 5 in which the tips of the blades are spaced radially from the inner margins of the baffles a distance on the order of one-half inch.

7. Apparatus as defined in claim 6 in which the radial width of each baffle is about one-tenth the diameter of the tank.

8. Apparatus as defined in claim 1 in which the prime mover rotates the shaft at a speed which produces a tangential velocity at the blade tips on the order of 7–9 feet per second.

9. A method of using a filled resin in a chopper type fiber-glass system comprising the steps of a. introducing the resin and the desired filler to the tank of the mixing apparatus defined in claim 1;

b. causing the prime mover of said mixing apparatus to drive the rotor shaft at a speed which produces a tangential velocity at the tips of the rotor blades on the order of 7–9 feet per second, to thereby effect thorough mixing of the resin and filler; and c. withdrawing the mixture from said tank and feeding it to the chopper gun.

10. A method as defined in claim 9 in which the resin-filler mixture is pumped directly from said tank to the chopper gun.

* * * * *